US006099282A

United States Patent [19]

Milligan

[11] Patent Number: 6,099,282

[45] Date of Patent: Aug. 8, 2000

[54] MULTIHOLE MELT BLOWN DIE NOSEPIECE

[75] Inventor: Mancil W. Milligan, Luttrell, Tenn.

[73] Assignee: The University of Tennessee Research Corporation

[21] Appl. No.: 09/295,023

[22] Filed: Apr. 20, 1999

[51] Int. Cl.[7] ..... B28B 17/00

[52] U.S. Cl. ..... 425/7; 425/72.2; 425/382 R; 425/382 N; 425/382.2; 425/464; 264/518; 264/555

[58] Field of Search ..... 425/7, 72.2, 382.2, 425/464, 382 R, 382 N; 118/411; 264/518, 555

[56] References Cited

U.S. PATENT DOCUMENTS 5,145,689 9/1992 Allen et al. ..... 425/72.2
5,511,960 4/1996 Terakawa et al. ..... 425/7
5,513,973 5/1996 Keil et al. ..... 425/382.2
5,750,159 5/1998 Delmore et al. ..... 425/190

*Primary Examiner*—Harold Pyon
*Assistant Examiner*—Joseph S. Del Sole
*Attorney, Agent, or Firm*—Duane, Morris & Heckscher LLP

[57] ABSTRACT

The present invention relates to a die for use in textile processes involving nonwoven melt blown fabrics. In a melt blown process, molten polymer resin is injected into a melt blown die and ejected from the die in the form of filaments. The present invention is directed to an improved die nosepiece comprising a multiplicity of adjacent holes offset with respect to each other at an angle greater than or equal to 5° and less than 90°, through which resin filaments are ejected.

11 Claims, 2 Drawing Sheets

MULTIHOLE MELT BLOWN DIE NOSEPIECE

BACKGROUND OF THE INVENTION

1. Field of the Invention

The present invention relates to a die for use in textile processes involving nonwoven melt blown fabrics. In a melt blown process, molten polymer resin is injected into a melt blown die and ejected from the die in the form of filaments. The present invention is directed to an improved die nosepiece comprising a multiplicity of adjacent holes offset with respect to each other at an angle greater than or equal to 5° and less than 90° through which resin filaments are ejected.

2. Description of the Prior Art

Prior art nosepieces for the die used in the melt blowing processes comprise a multiplicity of parallel adjacent holes. Because these holes are parallel, the resin filaments tend to be ejected from the holes in the same direction, causing filament to filament interactions, thereby resulting in shot formation. "Shot" is an imperfection found in meltblown webs which consist of a mass of polymer, often disk like, which has not been drawn to a diameter, similar to the diameter of surrounding fibers. The present invention provides a nosepiece that results in increased filament separation and draw-down, thereby resulting in reduced shot.

SUMMARY OF THE INVENTION

The present invention is directed toward a die nosepiece for a melt blowing device. The present invention comprises a body defining a resin receiving volume. The body further comprises a lower face, an upper face, and a front face at the intersection of the upper and lower faces.

The invention further comprises a resin inlet in fluid communication with the resin receiving volume, and a multiplicity of adjacent channels extending from the resin receiving volume to the surface of the front face. Each of the channels has a diameter in the range of 0.010 to 0.020 inches. The channels are spaced apart such that there are at least 20 channels per inch in the front face. Each pair of adjacent channels comprises a first channel angled toward the upper face and a second channel angled toward the lower face. The directional relationship between adjacent channels is defined by an offset angle, θ, that is greater than or equal to 5° and less than 90°.

DESCRIPTION OF THE PREFERRED EMBODIMENTS

Figure 1A:
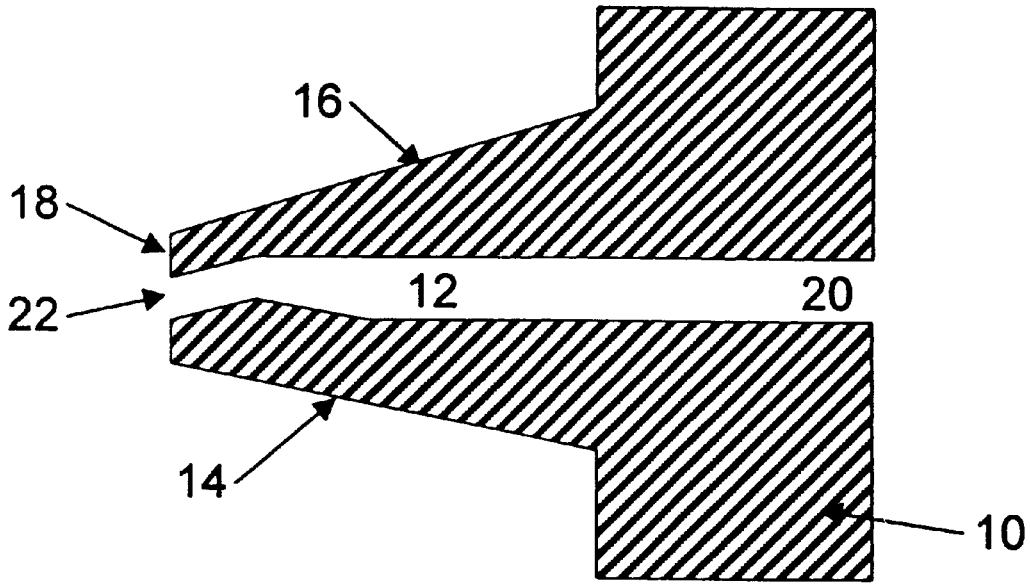
FIG. 1A is side cross sectional view of the present invention at channel 22.
Figure 1B:
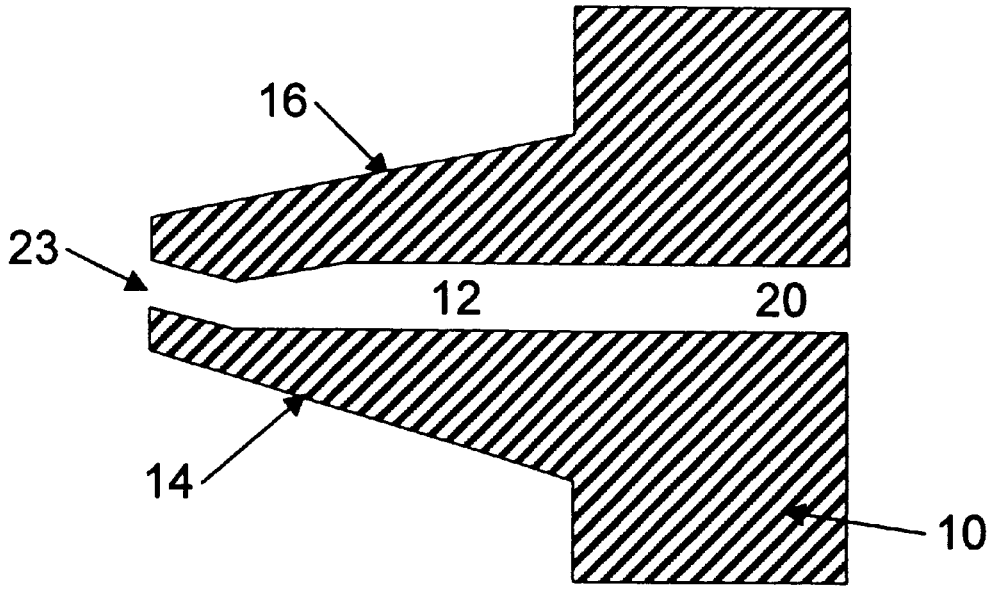
FIG. 1B is a side cross sectional view of the present invention at channel 23.

The present invention is directed toward a die nosepiece for a melt blowing device. The present invention comprises a body 10 defining a resin receiving volume 12, as shown in FIGS. 1A–1B. The body further comprises a lower face 14, an upper face 16, and a front face 18 at the intersection of the upper and lower faces. In a preferred embodiment, the width of the front face is in the range of 0.015 to 0.030 inches. In a preferred embodiment, the length of each die nosepiece is in a range of 1 to 10 feet.

The invention further comprises a resin inlet 20 in fluid communication with the resin receiving volume as shown in FIGS. 1A–1B. The resin inlet is sized to be coupled to a resin extruder of a melt blowing device.

Figure 2:
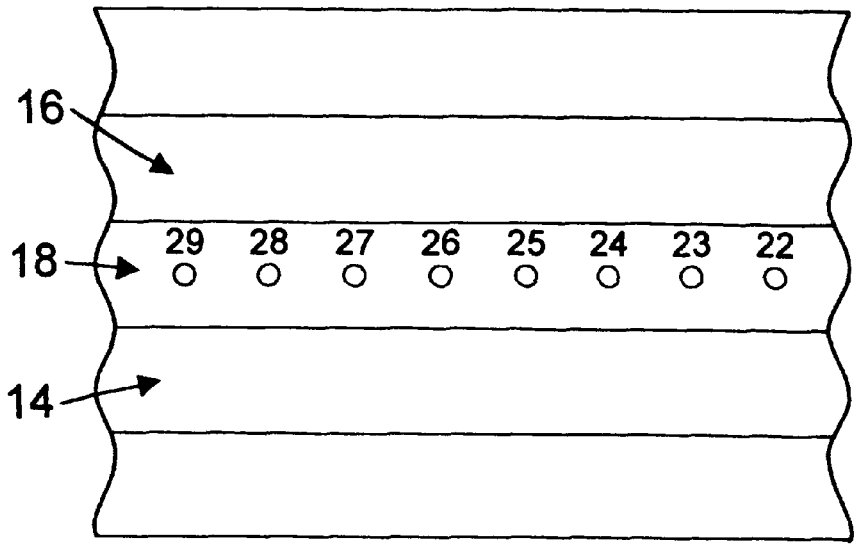
FIG. 2 is a front view of a section of the present invention.

The invention further comprises a multiplicity of adjacent channels 22–29 extending from the resin receiving volume to the surface of the front face, as shown in FIG. 2. Each of the channels has a diameter in the range of 0.010 to 0.020 inches. In a preferred embodiment, the diameter of each channel is 0.015 inches.

In a preferred embodiment, the length of each channel is at least 0.10 inches. In another preferred embodiment, the length of each channel is 0.150 inches.

The channels are spaced apart such that there are at least 20 channels per inch in the front face. In a preferred embodiment, the center lines of adjacent channels are spaced apart by 0.034 inches. In one preferred embodiment, there are no more than 35 channels per inch in the front face.

Figure 3:
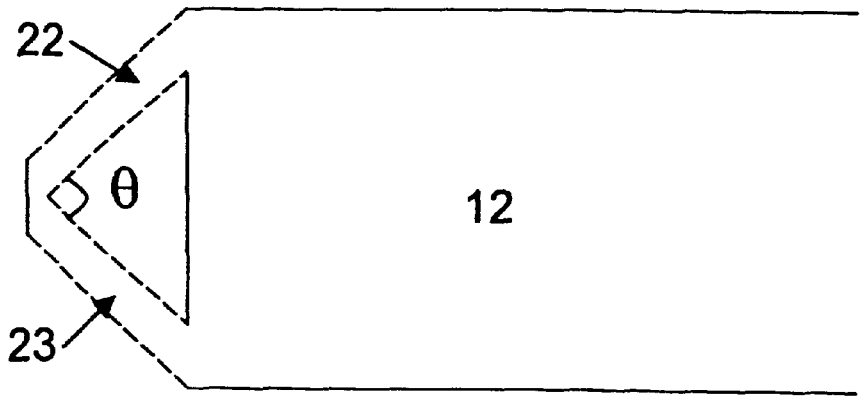
FIG. 3 is an enlarged cross sectional view of the resin receiving volume and one pair of adjacent channels of the present invention.

Each pair of adjacent channels comprises a first channel 22 angled toward the lower face and a second channel 23 angled toward the upper face, as shown in FIGS. 1A–1B and 3. The offset angle, θ, between adjacent channels is in the range of greater than or equal to 5° and less than 90° as shown in FIG. 3. In another preferred embodiment, the angle θ between adjacent channels is 30 degrees.

The foregoing disclosure and description of the invention are illustrative and explanatory. Various changes in the size, shape, and materials, as well as in the details of the illustrative embodiments may be made without departing from the spirit of the invention.

What is claimed is:

1. A die nosepiece for a meltblowing device, comprising:

a. a body defining a resin receiving volume, said body further comprising a lower face, an upper face, and a front face at the intersection of said upper and lower faces;

b. a resin inlet in fluid communication with said resin receiving volume; and c. a multiplicity of adjacent channels extending from said resin receiving volume to the surface of said front face, each of said channels having a diameter in the range of 0.010 to 0.020 inches, wherein said channels are spaced apart such that there are at least 20 channels per inch in said front face and each pair of adjacent channels comprises a first channel angled toward said upper face and a second channel angled toward said lower face to form an offset angle between said first and second channels that is greater than or equal to 5° and less than 90°.

2. The device of claim 1, wherein there are no more than 35 channels per inch in said front face.

3. The device of claim 1, wherein the width of said front face is in the range of 0.015 to 0.030 inches.

4. The device of claim 1, wherein the length of each channel is at least 0.10 inches.

5. The device of claim 1, wherein the center lines of adjacent channels are spaced apart by 0.034 inches.

6. The device of claim 1, wherein the length of said front face is in the range of 1 to 10 feet.

7. A die nosepiece for a meltblowing device, comprising:

a. a body defining a resin receiving volume, said body further comprising a lower face, an upper face, and a front face having a width in the range of 0.015 to 0.030 inches at the intersection of said upper and lower faces;

b. a resin inlet in fluid communication with said resin receiving volume; and c. a multiplicity of adjacent channels extending from said resin receiving volume to the surface of said front face, each of said channels having a diameter in the range of 0.010 to 0.020 inches, wherein said channels are spaced apart such that there are at least 20 channels per inch in said front face and each pair of adjacent channels comprises a first channel angled toward said upper face and a second channel angled toward said lower face, to form an offset angle between said first and second channels that is greater than or equal to 5° and less than 90°.

8. The device of claim 7, wherein the length of said front face is in the range of 1 to 10 feet.

9. The device of claim 7, wherein the length of each channel is at least 0.10 inches.

10. The device of claim 7, wherein there are no more than 35 channels per inch in said front face.

11. A die nosepiece for a meltblowing device, comprising:

a. a body defining a resin receiving volume, said body further comprising a lower face, an upper face, and a front face having a width in the range of 0.015 to 0.030 inches at the intersection of said upper and lower faces, said front face having a length in the range of 1 to 10 feet;

b. a resin inlet in fluid communication with said resin receiving volume; and c. a multiplicity of adjacent channels extending from said resin receiving volume to the surface of said front face, each of said channels having a diameter in the range of 0.010 to 0.020 inches, wherein said channels are spaced apart such that there are at least 20 and no more than 35 channels per inch in said front face and each pair of adjacent channels comprises a first channel angled toward said upper face and a second channel angled toward said lower face, to form an offset angle between said first and second channels that is greater than or equal to 5° and less than 90°.

* * * * *